United States Patent [19]

Herbst

[11] Patent Number: 4,513,556

[45] Date of Patent: Apr. 30, 1985

[54] REMOVABLE TENSION MEMBER FOR A GROUT ANCHOR

[75] Inventor: Thomas Herbst, Wessling, Fed. Rep. of Germany

[73] Assignee: Dyckerhoff & Widmann Aktiengesellschaft, Munich, Fed. Rep. of Germany

[21] Appl. No.: 310,870

[22] Filed: Oct. 13, 1981

[30] Foreign Application Priority Data

Oct. 16, 1980 [DE] Fed. Rep. of Germany ..... 3039080

[51] Int. Cl.[3] ..... E04B 1/38; E02D 5/80

[52] U.S. Cl. ..... 52/698; 52/166; 52/169.1; 52/704; 405/259

[58] Field of Search ..... 52/698, 223, 223 L, 52/223 R, 704, 148, 701, 166, 169.1, 127.1; 411/63, 75, 76, 80; 249/71, 63, 64, 175, 178, 249/180, 151, 152; 403/16, 21, 167; 405/259

[56] References Cited

U.S. PATENT DOCUMENTS

| | | | |
|---|---|---|---|
| 780,957 | 1/1905 | Palmer | 52/698 |
| 1,318,680 | 10/1919 | McNeill | 52/698 |
| 1,573,151 | 2/1926 | Fishel | 52/698 |
| 2,543,683 | 2/1951 | Arisman, Jr. | 411/63 |
| 2,825,957 | 3/1958 | Von Heidenstam | 52/223 R |
| 3,172,603 | 3/1965 | Bell et al. | 52/698 |
| 3,279,301 | 10/1966 | Fischer | 52/704 |
| 3,427,772 | 2/1969 | Williams | 52/223 R |

FOREIGN PATENT DOCUMENTS

| | | | |
|---|---|---|---|
| 3144 | 12/1889 | United Kingdom | 52/375 |
| 819828 | 12/1959 | United Kingdom | 52/223 L |

*Primary Examiner*—Alfred C. Perham

*Attorney, Agent, or Firm*—Toren, McGeady, Stanger, Goldberg & Kiel

[57] ABSTRACT

A temporary anchor for securing part of a structure to the earth includes a tension member made up of at least two complementary shaped parts forming a regular shaped exterior. One or more ribs are formed on the exterior peripheral surface of each part so that it can be engaged within a settable grout material when it is inserted into a borehole formed in the earth. A spacer member is positioned between facing surfaces of the tension member parts and holds them in spaced relation along the length of the parts within the borehole. The spacer member is removable from between the parts when they are anchored in a grout substance so that the parts can then be removed by exerting a pulling force on them. The dimension of the spacer member between the facing surfaces of the parts is at least equal to the dimension of the ribs outwardly from the parts, whereby upon removal the spacer member leaves an open space within the borehole sufficient for the part to move inwardly with its rib being fully displaced from the grout substance for removal of the part out of the borehole.

12 Claims, 6 Drawing Figures

REMOVABLE TENSION MEMBER FOR A GROUT ANCHOR

SUMMARY OF THE INVENTION

The present invention is directed to a tension member for a grout anchor made up of two or more tension parts or bars, such as steel rods, each having a complementary shape and forming a regular exterior periphery, such as a circular periphery or a similar regular shape. The tension member parts are provided on their exterior peripheral surfaces with ribs for transmitting a pulling force to a grout substance embedding the tension member. The grout substance is a settable material, such as cement mortar.

Earth anchors constructed as grout anchors for temporarily anchoring parts of a structure, often must be removed after they are no longer needed. The necessity for removal occurs when anchored excavation walls extend along the boundary of an adjacent plot of land with the anchors extending into the adjacent plot. For at least removing and recovering the tension members in these grout anchors, in the range of the free length of the tension members, in a known method the tension members can be separated at the transition between the anchored section and the free section extending out of the borehole. Separation of these sections can be effected by providing a predetermined breaking point in the tension member in the transition region. As an alternative, the tension member can be formed by joining two parts together such as by securing threaded end sections by means of a sleeve so that one section can be unscrewed from the other.

Special provisions are required when the tension member is to be removed from the borehole where it is anchored in the grout substance. It is known to use an anchoring body of a material capable of withstanding high forces in the direction of its longitudinal axis but which can withstand only slight forces transversely of its longitudinal axis, for example, an anchoring body formed of glass fibers, note German patent 26 06 095. In such an anchor, it is necessary to provide a connection between the tension member and the anchoring body which requires detachability.

Where a grout anchor is being used, it is necessary to transmit the tension or pulling forces as completely as possible to the grout substance while utilizing an anchor borehole having a diameter which is as small as possible. Such an anchor is achieved where the tension member is made up of two or more steel bars which complement one another and form a uniform, essentially circular cross-section, note German patent 24 12 459. Ribs are provided on the exterior peripheral surface of the steel bars and extend along a spiral line in the form of a thread. By longitudinally sliding the individual steel bars against one another it is possible to arrange the bars to form a continuous thread onto which an anchoring body can be screwed. In screwing the tension member out of an anchor head by applying torque exterior of the anchor borehole, there is a tendency for the bars to slip relative to one another and to jam in the thread with the result that in such an arrangement a detachable connection cannot be effected.

It is the primary object of the present invention to provide tension members for a grout anchor made up of several parts or bars, such as steel bars with the parts being arranged so that the entire tension member can be removed from an anchor borehole so that it can be reused.

In accordance with the present invention, in the anchored position the individual parts of the tension member are spaced from one another by one or more spacer members which can be removed from outside the borehole. The distance between the tension member parts provided by the spacer members roughly corresponds to the outwardly extending dimension of the ribs on the parts.

When the grout anchor is no longer needed, the spacer member or members can be removed out of the borehole. The spacer members can be in the form of one or more wires, tubes or similar parts which can extend for the full length of the tension member.

It is also possible, however, to provide the spacer member or members only between the tension member parts located within the anchor borehole. The spacer member or members can be removed by physical or chemical means.

It is advantageous if the individual parts of the tension member, such as steel bars, are coated at least for the length of the anchored portions, with a substance which prevents a bond with the grout material.

The basic concept underlying the invention is that the spacer members spread the individual parts of the tension member apart and effect their embedment in the grout material. When the spacer members are withdrawn from between the tension parts and out of the anchor borehole, an open space is provided between the individual parts. If a pulling force is applied to an individual tension member part it can move radially inwardly within the borehole out of locking contact with the grout material so that first one and then the others of the tension member parts can be withdrawn out of the anchor borehole.

In the present invention it is not necessary for the force transmission ribs to be in the form of threads. On the contrary, other forms of ribs can be used, such as ribs extending perpendicularly to the axis of the anchor hole or in the form of cams or other shapes which can provide the force transmission effect while being readily releasable from locking contact with the grout material when the spacer member or members are removed and a pulling force is exerted on the tension member parts.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
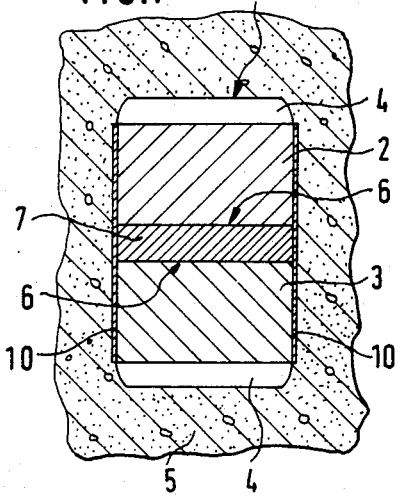
FIG. 1 is cross-sectional view of a grout anchor tension member secured within a grout material and incorporating the present invention.
Figure 2:
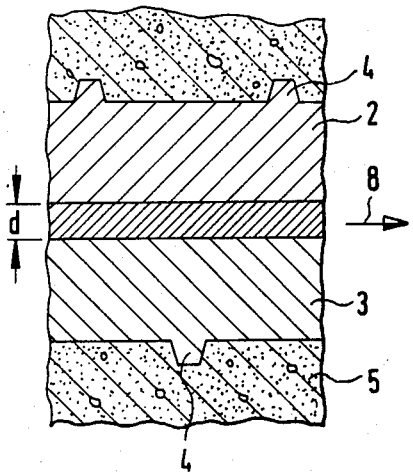
FIG. 2 is a partial longitudinal sectional view of the tension member illustrated in FIG. 1.

A tension member 1, shown in transverse section in FIG. 1, and in longitudinal section in FIG. 2, is made up of two separate parts or bars 2, 3, each bar having a rectangular cross-section. The oppositely directed exterior peripheral surfaces of the bars 2 and 3 are provided with ribs 4. When the bars 2 and 3 are placed within an anchor borehole and surrounded with a grout material 5, the ribs are anchored within the grout material and provide a shear force securing the tension member in place. Each bar 2, 3 has an interior surface 6 facing the other and a flat bar 7 of rectangular cross-section forms a spacer member between the two bars maintaining the interior surfaces 6 in spaced relation. The thickness d of the bar or spacer member 7 corresponds at least to the dimension or height of the ribs 4 extending outwardly from the exterior surface of the bars 2, 3.

Spacer member 7 is required only for the length of the tension member located within the anchor borehole, that is, the length embedded in the grout material. Exteriorly of the anchor borehole, the tension member can be extended by a connection capable of transmitting tension force, for example, a steel wire. The connection can be secured to the tension member where it extends out of the anchor borehole. It is also possible, however, to provide the bar or spacer member 7 for the full length of the tension member outside of the anchor borehole.

Figure 3:
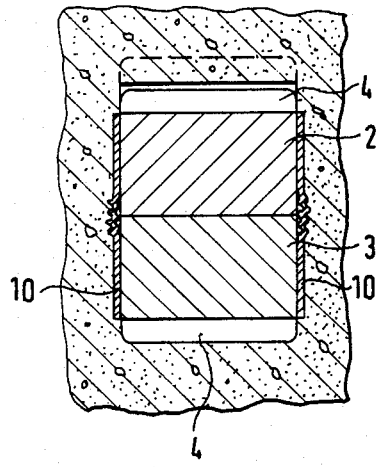
FIG. 3 is a view similar to FIG. 1, however, with the spacer member of FIG. 1 removed from between the tension member parts.
Figure 4:
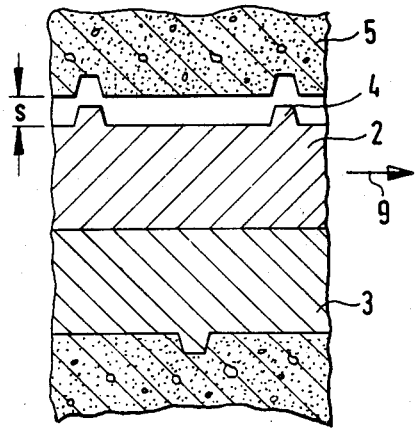
FIG. 4 is a longitudinal sectional view similar to FIG. 2, but with the spacer member removed.

With the bars 2 and 3 of the tension member 1 secured within the grout material in an anchor borehole, the bar or spacer member 7 can be pulled in the direction of the arrow 8 from between the bars 2 and 3 out of the borehole, note FIGS. 3 and 4 where the spacer member has been removed from between the bars. With the removal of the spacer member, an open space is provided having a height comparable to the thickness dimension d of the spacer member and equal at least to the dimension of the ribs 4 extending outwardly from the exterior peripheral surface of the bars 2,3. When a pulling force is applied to one of the bars in the direction of the arrow 9, note FIG. 4, the bar separates from the bond with the grout material and can be pulled out of the opening formed by the grout material. As can be noted in FIG. 4, if the open space left by the removal of the spacer member 7 is at least equal to the height of the ribs 4, the bar 2 when its bond with the grout material is broken can move inwardly until it contacts the other bar 3. With the outside surface of the ribs spaced slightly inwardly of the inside surface of the grout material within the opening containing the tension member, the bar 2 can be removed from the anchor borehole. Subsequently, the other bar 3 can also be disengaged from the grout material and removed from the borehole. To assure that the bars 2,3 are capable of moving into the open space left by the spacer member 7, plates 10 can be positioned on both sides of the bars 2,3 extending transversely of the sides containing the ribs 4 so that there is no bonding action between these sides and the grout material. Instead of the plates 10, a coat of paint or similar material can be provided on the bars to prevent a bond being developed between the tension member and the grout material. Under certain circumstances, the coat of paint can be formed on the ribs 4 so that the anchoring effect provided by the tension member takes place exclusively through the shear bond provided by the ribs.

Figure 5:
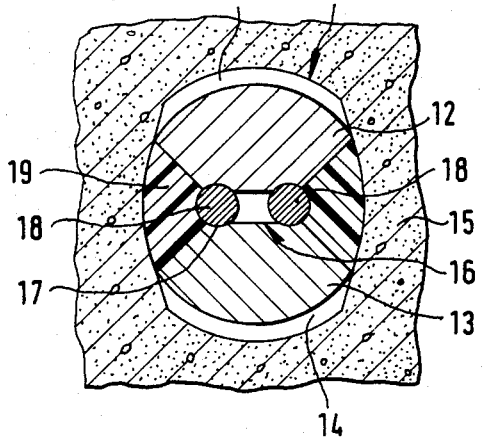
FIG. 5 is a cross-sectional view, similar to FIG. 1, through another tension member made up of two parts forming an approximately circular cross-section.

In FIG. 5 another tension member 11 is illustrated made up of two bars or parts 12, 13 each being provided with a complementary shape so that the exterior peripheral surface of the tension member is approximately circular, that is, the opening within the grout material has a circular cross-section. Each bar 12, 13 has ribs 14 formed on its exterior peripheral surface in contact with the grout material 15. Ribs 14 are embedded in the grout material and provide a locking action securing the tension member within an anchor borehole. The facing surfaces 16 of the bars 12, 13 each have a pair of shallow depressions 17 in which two round wires or spacer members 18 are positioned for maintaining the bars in spaced relation. For reasons of rolling mill technique, portions of the outer surfaces of the bars 12, 13 are cut away and the resulting spaces are filled with inserts 19 of a compressible material. When the tension member 11 along with the spacer members 18 are grouted into an anchor borehole, the spacer members can be withdrawn in the axial or longitudinal direction of the tension member and, when completely removed, an open space is provided so that first one of the bars 12, 13 can be separated from the grout material and moved radially inwardly and then withdrawn in the axial direction out of the space formed within the grout material. With the spacer members 18 removed, the compressible material inserts 19 offer no resistance to the removal of the bars 12, 13.

Figure 6:
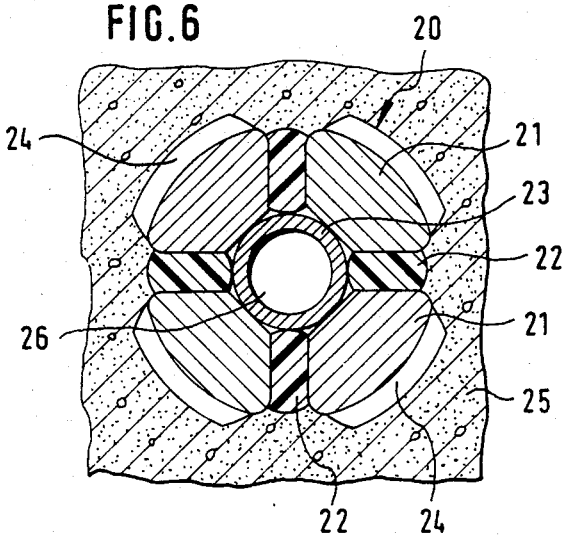
FIG. 6 is a cross-sectional view through still another tension member embodying the present invention where the member is made up of four parts and also has an approximately circular cross section.

In FIG. 6 still another embodiment of the invention is disclosed with a tension member 20 made up of four parts or bars 21 each having ribs 24 formed on the exterior peripheral surface of the tension member so that the ribs interlock within the grout material 25. In this embodiment, as in the one shown in FIG. 5, the exterior periphery of the tension member 20 is circular. Within the axial center region of the tension member 20, a tubular member 23 extends along the length of the bars 21 and maintains them in a spaced relation opposite one another. In addition, the bars 21 are dimensioned so that when uniformly spaced around the tubular member 23 they are spaced apart along lateral surfaces by strips 22 of an elastically compressible material. The inner wall 26 of the spacer member 23 defines a conduit which can be used for injection or ventilation. If the temporary anchor is no longer required, the tension member can be removed from the anchor borehole by first removing the spacer member 23 completely out of the space inwardly of the tension member parts or bars 21. With the spacer member 23 removed, an open space is provided into which one of the bars 21 can be moved radially inwardly out of engagement with the grout material 25. When the bar 21 has been moved inwardly a sufficient distance so that its ribs will clear the surface of the grout material 25, the bar can be pulled axially out of the anchor borehole. As with the embodiment shown in FIG. 5, the strips 22 do not impede the removal of the bars. In turn, each bar can be broken clear from the grout material 25 and removed from the borehole.

It can be appreciated that the dimensions of the spacer members must be such that, when they are removed, the individual parts of the tension members 1, 11, 20 can be moved radially inwardly out of contact with the grout material and then pulled axially out of the opening formed within the grout material.

It is preferable to form the tension members 1, 11, 20 of steel bars, however, other metals can be used and in certain instances other materials employed for the bars, such as plastics materials or bars formed of glass fibers and plastics materials.

While specific embodiments of the invention have been shown and described in detail to illustrate the application of the inventive principles, it will be understood that the invention may be embodied otherwise without departing from such principles.

I claim:

1. Tension member for a grout anchor such as for temporarily anchoring a structure to the earth, said tension member being insertable into a borehole formed in the earth so that in the inserted position said tension member can be grouted in for affording a temporary anchoring effect and subsequently can be removed from the borehole when the anchoring effect is no longer required, said tension member having an elongated central axis and comprising at least two elongated co-extensive complementary shaped bars extending in the direction of the central axis and capable of transmitting tensile forces and forming, in combination, a regular exterior periphery extending around and spaced radially outwardly from the central axis and defining the outside surface of said shaped bars, each said bar having a first end arranged to be inserted first into the borehole and a second end arranged to receive a pulling force, in the inserted position said bars disposed in spaced relation and having opposed facing first surfaces located inwardly of the exterior periphery directed toward the central axis and spaced outwardly from the central axis, ribs formed on and projecting outwardly beyond the exterior periphery of said bars with said ribs extending across the exterior periphery generally transversely of the elongated direction of said bars so that said ribs have a rectilinear transversely extending dimension, in the inserted position of said tension member forming a temporary anchor said ribs are arranged to be engaged within a settable grout material such as a cement grout, and first means extending in the elongated direction of said bars and having oppositely disposed second surfaces positioned between and being in axially sliding contact with the opposed facing first surfaces of said bars in the inserted position of said tension member for maintaining the facing first surfaces in spaced relation, said first means extending along the central axis, at least one of said first and second surfaces being smooth and flat in the elongated direction of said bars, said first means being slidably removable by rectilinear movement in the direction of the central axis from between said bars and, when removed, providing an open space of the same dimension in the central axis direction between the facing first surfaces and having at least a dimension perpendicular to the central axis direction and extending between the opposed facing first surfaces so that a pulling force exerted on the second end of said bars one at a time permits said bars to move inwardly toward the central axis freeing said ribs from engagement with the grout material whereby said bars can then be withdrawn from the borehole in the direction of the central axis.

2. Tension member, as set forth in claim 1, wherein said bars are formed of steel.

3. Tension member, as set forth in claim 1, wherein in section perpendicular to the central axis the exterior periphery of said tension member is subsequently rectangular.

4. Tension member, as set forth in claim 1, wherein in section perpendicular to the central axis the exterior periphery of said tension member is approximately circular.

5. Tension member, as set forth in claim 3, wherein said first means comprises at least one spacer member and said spacer member is rectangular in section perpendicular to the central axis.

6. Tension member, as set forth in claim 4, wherein said first means comprises at least one spacer member and said spacer member comprises at least one circular wire-like member.

7. Tension member, as set forth in claim 4, wherein said first means comprises at least one spacer member and said spacer member comprises a tubular member.

8. Tension member, as set forth in claims 5, 6 or 7, wherein said at least one spacer member extends for the entire length of said bars forming said tension member.

9. Tension member, as set forth in claims 5, 6 or 7, wherein said at least one spacer member extends only for the length of said bars arranged to be in contact with the grout material.

10. Tension member, as set forth in claim 1, including second means for preventing said bars forming said tension member from bonding with the grout material.

11. Tension member, as set forth in claim 10, wherein said second means comprises plates separate from and extending along at least a portion of the exterior periphery of said tension member spaced angular about the central axis from said ribs so that the exterior periphery covered by said plate is free of interengagement with grout in the borehole in the inserted position of said tension member.

12. Tension member, as set forth in claim 10, wherein said second means comprises a layer of paint deposited on the exterior periphery of said bars forming said tension member for preventing the formation of a bond between daid bars and the grout in the inserted position of said tension member grouted within the borehole.

* * * * *